United States Patent [19]

Eheim et al.

[11] Patent Number: 4,475,519

[45] Date of Patent: Oct. 9, 1984

[54] FUEL INJECTION SYSTEM FOR INTERNAL COMBUSTION ENGINES

[75] Inventors: Franz Eheim; Wolfgang Fehlmann, both of Stuttgart, Fed. Rep. of Germany

[73] Assignee: Robert Bosch GmbH, Stuttgart, Fed. Rep. of Germany

[21] Appl. No.: 303,333

[22] Filed: Sep. 18, 1981

[30] Foreign Application Priority Data

Oct. 6, 1980 [DE] Fed. Rep. of Germany ..... 3037730

[51] Int. Cl.[3] ..... F02M 39/00

[52] U.S. Cl. ..... 123/502; 123/357; 123/387; 137/831

[58] Field of Search ..... 123/494, 502, 357, 387; 137/831, 832

[56] References Cited

U.S. PATENT DOCUMENTS 3,630,643 12/1971 Eheim et al. .
3,724,430 4/1973 Adler ..... 123/357
3,774,644 11/1973 Leutner ..... 137/831
3,815,564 6/1974 Suda ..... 123/502
4,306,528 12/1981 Straubel ..... 123/357
4,345,563 8/1982 Eheim ..... 123/357

*Primary Examiner*—Charles J. Myhre
*Assistant Examiner*—Carl Stuart Miller
*Attorney, Agent, or Firm*—Edwin E. Greigg

[57] ABSTRACT

A fuel injection system is proposed which serves to inject fuel into the combustion chambers of internal combustion engines. The fuel injection system includes at least one inlet and one outlet line each for the fuel, at least one pump piston to supply the fuel to an injection valve, and at least one apparatus to adjust a parameter of the injection system, such as instant of injection, or quantity of injection, or both. Furthermore, the fuel injection system includes an electro-fluidic transducer which can be controlled by an electronic control device, the electro-fluidic transducer acting to adjust the desired parameter.

11 Claims, 5 Drawing Figures

FUEL INJECTION SYSTEM FOR INTERNAL COMBUSTION ENGINES

BACKGROUND OF THE INVENTION

The invention is directed to a fuel injection system provided with novel means to adjust a parameter of injection, such as the instant or quantity thereof. A fuel injection system is already known in which an injection parameter adjustment is determined by the rpm of the engine or by the pressure existing in the inner chamber (intake chamber) of an injection pump associated with the fuel injection system. This known system has numerous disadvantages. The known parameter adjustment apparatus does not offer the possibility for an electronic control thereof. Furthermore, the cyclic magnetic valve used in the known fuel injection system causes variations in the instant of ignition. The relatively large operating current needed to actuate the magnetic valves results in high manufacturing costs as well. Finally, should a failure of the electrical system occur, the magnetic valve assumes an extreme position (open or closed) which can be very dangerous for the internal combustion engine. For a better understanding of this subject matter the reader should refer to Eheim et al U.S. Pat. No. 3,630,643 and Leutner et al U.S. Pat. No. 3,774,644 both of which are assigned to the assignee of this application.

OBJECT AND SUMMARY OF THE INVENTION

It is a principal object of the novel fuel injection system according to the invention that a direct engagement of an electronic control device with the control sequence of an injection system is possible via the electro-fluidic transducer. Thus, the moment of injection is constantly controlled.

It is a further object of the invention that with an appropriate adjustment of the electro-fluidic transducer, the transducer can be placed in a predetermined position which will not be harmful to the internal combustion engine should the normal engine operation be disturbed.

The invention will be better understood and further objects thereof will become more apparent from the ensuing detailed description of five preferred embodiments taken in conjunction with the drawings.

DESCRIPTION OF THE PREFERRED EMBODIMENTS

Figure 1:
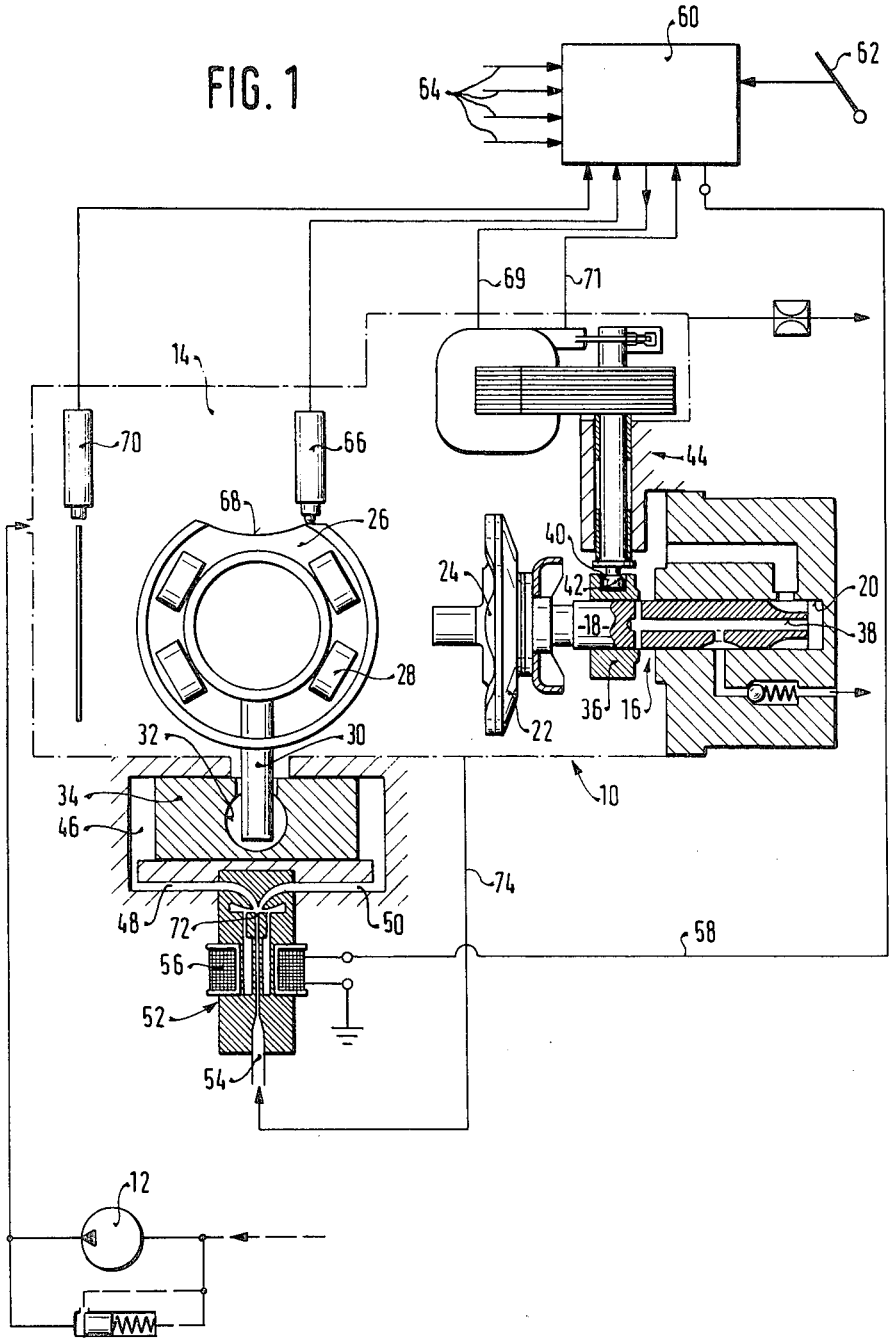
FIG. 1 is a schematic representation of a fuel injection system showing cross-sectional detail of a roller ring associated with an injection pump and a stroke disk for driving the roller ring, the roller ring being rotated by an angle of 90 degrees for purposes of clarity.

The injection pump schematically shown in FIG. 1 forms a portion of a fuel injection system for internal combustion engines. A fuel supply pump 12 is provided for the injection pump 10. The supply pump 12 and the injection pump 10 usually comprises a structural unit. The injection pump 10 has an intake chamber 14 which is filled with fuel by the fuel supply pump 12. Pressurization above atmospheric is provided in the intake chamber 14. The fuel supply pump 12 is provided with as many individual fuel injection pumps 16 as the internal combustion engine (not shown) has combustion chambers. In describing the fuel injection system, though, it is sufficient for clarity for the description to limit itself to the sole individual fuel injection pump 16 shown in the drawing. The individual fuel injection pump 16 includes a pump piston 18 which is rotatable and displaceably guided in an axial direction in a cylinder 20. A stroke disk 22 is positively associated with the extremity of the pump piston 18 protruding from the cylinder 20. This stroke disk 22 is provided with as many cams 24 on its opposite front side, remote from the pump piston 18, as there are individual fuel injection pumps 16. The stroke disc 22 is juxtaposed coaxially with a roller ring 26. In reference to the drawing according to FIG. 1, it must be noted again that the roller ring 26 as shown is rotated at an angle of 90 degrees from its normal orientation. In practice, the peripheral area or surface of the rollers 28 tightly abuts the front side of the stroke disc 22—on which the cams are disposed—when the injection pump 10 is operating. The roller ring 26 further includes a radial attachment 30 which engages a recess 32 in a slide block 34. An annular governor slide 36 is disposed on the pump piston 18 between the stroke disk 22 and the pump piston 18. The governor slide 36 is displaceable in such a manner on the pump piston 18 that it overrides a supply channel 38 for the fuel; this supply channel 38 is provided longitudinally in the piston 18 and discharges laterally through the wall of the pump piston. A bolt 42 of a quantity signaling device 44, via which the governor slide 36 can be displaced on the pump piston 18, engages a pocket 40 disposed in the wall of the governor slide 36.

The slide block 34 cooperating with the attachment 30 of the roller ring 26 is provided in a chamber 46 in a displaceable fashion. In reference to the drawing in FIG. 1 it should be noted here, that the slide block 34, together with its chamber 46, is rotated by 90 degrees, as well, so that its cooperation with the roller ring 26 can be more readily understood. Outlet lines 48, 50 discharge into the chamber 46 from both sides of the slide 34 when the slide block is in the central position in the chamber 46. The outlet line 50 is in connection with an electro-fluidic transducer 52 which has an inlet 54 for a pressure medium flow. A magnetic coil 56, which communicates with an electronic control device 60 via an electric supply line 58, is provided in the electro-fluidic transducer 52. The electronic control device 60 further receives a signal originating from a gas pedal 62 and other operational engine parameters as feedback characteristics, such as temperatures and air pressure (arrows 64). Finally, a closed loop feedback signal of a closed loop feedback means 66 is transmitted to the electronic control device, as well. The closed loop feedback means 66 scans a governor curve 68 disposed on the circumference of the roller ring 26. The signal of a rpm transmitter 70 also is communicated to the electronic control device 60. Control impulses and/or closed loop feedback impulses are guided via control lines 69 and 71 between the electronic control device 60 and the quantity signaling device 44.

The above described fuel injection system functions as follows in reference to the instant invention: the instant of injection must be advanced for known reasons when the rpm level accelerates. So as to achieve this, the roller ring 26 is turned in the direction 'forward' by a certain angle in a known manner. In the fuel injection system according to the invention the necessity of this correction is recognized, for example, by the electronic control device 60 via the rpm transmitter 70. The magnetic coil 56 of the electro-fluidic transducer 52 is then excited via the supply line 58 such that a valve 72 disposed downstream of the inlet 54 acts upon one of the outlet lines 48, 50 more strongly than the other. This causes the slide block 34 to be displaced in the direction of the chamber 46 which is being less strongly influenced, whereby the attachment 30 and thus the roller ring 26 are moved as well, because of a relative shift of the position of the recess 32 in the slide block 34. It is obvious that the outlet line 48 or 50, which forces a displacement of the slide block 34 and thus a timing of the roller ring 26 in the desired direction, is more strongly urged by the valve 72. The electronic control device 60 receives information on the position of the roller ring 26 at any given time by the closed loop feedback means 66 which comprises a potentiometer. The inlet 54, by which the pressure medium flow is guided to the electro-fluidic transducer 52, can communicate, for example, with the intake chamber 14 via a pressure line 74. It is also possible, though, that a pressure medium flow for displacing the slide block 34 is guided to the transducer 52, and/or to its inlet 54, from a separate closed circuit and a pump arranged in said circuit.

Figure 2:
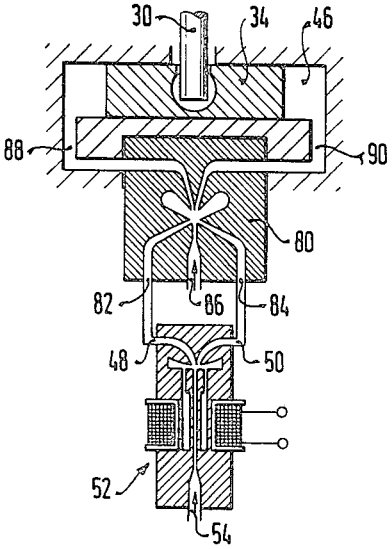
FIG. 2 is an enlarged cross-sectional view of a portion of FIG. 1 showing an electro-fluidic transducer with an intensifier stage disposed behind this transducer, wherein a slide bar which acts to displace a slide block is in a central position.
Figure 3:
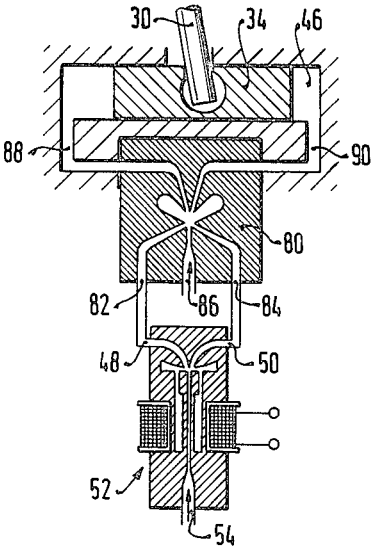
FIG. 3 shows the electro-fluidic transducer according to FIG. 2, wherein the slide bar has been moved into a non-central position.

It is furthermore possible that the electro-fluidic transducer 52 can serve as an input stage to a fluidic intensifier device 80 (FIGS. 2 and 3). In this case the outlet lines 48 and 50 of the transducer 52 are connected to control inlets 82 and 84 of the intensifier device 80. Thus the pressure medium flowing into the inlet 54 of the transducer 52 functions only to control a working-pressure medium flow which is guided to an inlet 86 of the intensifier device 80. The outlets 88 and 90 of the intensifier device 80 lead to the chamber 46 in which the slide block 34 is moveably disposed. FIG. 3 shows that the slide block 34 has been displaced to the right from a neutral central position and the roller ring 26 has been displaced by the attachment 30.

Figure 4:
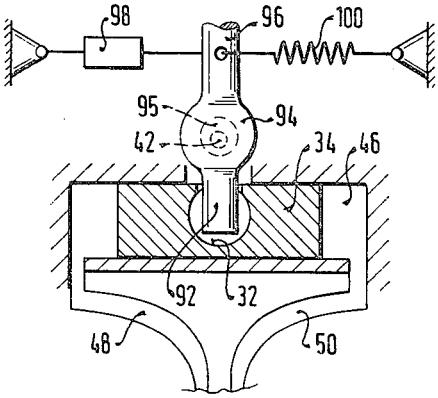
FIG. 4 shows schematically an arrangement for influencing the injection quantity of an injection pump by means of an electro-fluidic transducer.

The embodiment according to FIG. 4 shows an apparatus for influencing the quantity of fuel to be injected during a stroke of the piston. The construction of the electro-fluidic transducer corresponds to that described above. The two outlet lines 48, 50 also discharge into the chamber 46 in which a slide block 34 is provided in a displacement manner. A protruberance 92 is provided on a transfer element 94, which comprise a two-armed lever, one arm of which comprises the protruberance 92. A closed loop feedback means 98 which communicates with the control device 60 and a stabilizing spring 100 engage the opposite arm 96. A turning pin 95 is provided centrally of the transfer element 94. The axis of the turning pin 95 is arranged vertically on the transfer element 94. On the side remote from the transfer element 94 the turning pin 95 is provided with an eccentric bolt 42 (see FIGS. 1 and 4) which engages the pocket 40 in the governor slide 36. Rotation of the turning pin 95 causes a displacement of the governor slide 36 on the piston 18.

Figure 5:
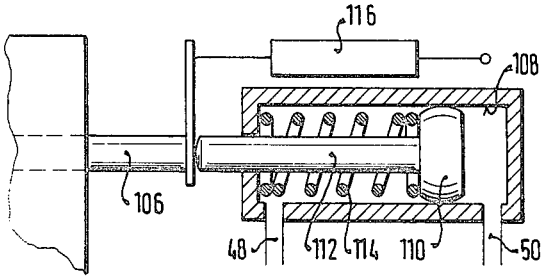
FIG. 5 shows schematically an arrangement for displacing an adjusting rod of an injection pump by means of an electro-fluidic transducer.

The embodiment according to FIG. 5 relates to a quantity control device in a fuel injection apparatus with various pump pistons. Certain of such injection pumps are called series injection pumps, because the individual pumps are disposed in series. The regulation of the injection quantity in these injection pumps takes place via an adjusting rod 106 which is displaced either more or less in an axial direction. In the embodiment of the invention according to FIG. 5 the two outlet lines 48 and 50 of the electro-fluidic transducer 52 discharge into a chamber 108 in which a piston 110 is arranged in a displaceable manner. A shaft 112 extending in the direction of displacement of the piston 110 is provided on this piston. The shaft 112 abuts the outward side of the adjusting rod 106. The adjusting rod 106 and the shaft 112 are coupled together in a force-locking or form-locking manner. A helical spring 114 is provided in the chamber 108 to stabilize the action of the piston 110. Furthermore, a closed loop feedback means 116 is provided in engagement with the adjusting rod 106. The closed loop feedback means 116 transmits the instantaneous position of the adjusting rod 106 to the electronic control device 60. To displace the adjusting rod 106, the piston 110 is, according to need, selectively urged more strongly via the outlet line 50 of the electro-fluidic transducer 52, which influences the injection quantity of the individual pumps in the same manner.

It is common to all of the preferred embodiments described above that the apparatus for adjusting a parameter of the injection system, whether instant of injection or quantity of the injection is an electro-fluidic transducer 52 which is controlled by an electronic control device 60.

The two stabilizing springs 100 (FIG. 4) and 114 (FIG. 5) are pre-tensioned so that the governor slide 36 and/or the adjusting rod 106 will assume a non-supplying position in case of any disturbance in the electronic control device 60.

It should be mentioned that the electro-fluidic transducer 52 has been exhaustively described and shown in U.S. Pat. No. 3,774,644. The content of this patent is herewith incorporated by reference into the disclosure of this application.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines having at least one inlet line and one outlet line for fuel flow, at least one pump piston to supply said fuel to an injection valve of said engine, said system further including a control apparatus, said control apparatus including at least one work chamber, a movable element in said work chamber, means for coupling said movable element with an adjusting device of the fuel pump piston, at least one pressure line connected to said work chamber, a pressure fluid quantity control device for controlling fluid under pressure in said at least one pressure fluid line of the work chamber, an electrical control device electrically connected to said pressure fluid quantity control device for controlling a fluid flow path through said pressure fluid quantity control device to said at least one work chamber, characterized in that said pressure fluid quantity control device is an electro-fluidic converter which comprises a fluid stream tube that is elastically deflectable out of an outset position by means of at least one electromagnet, said fluid stream tube communicates with a fluid input source at one end and includes a nozzle outlet and said electro-fluidic converter has first and second interceptor nozzles and the fluid stream tube can be controlled by the electrical control apparatus to overlap one of said interceptor nozzles by deflection of the fluid stream tube out of an outset position or brought into an intermediate position thereof, in which the nozzle outlet of said fluid stream tube is located between said first and second interceptor nozzles and wherein said first interceptor nozzle communicates via a first pressure fluid line with the work chamber on one end of said movable element and the second interceptor nozzle communicates via a second pressure line with said work chamber on an opposite end of said movable element from that of said first pressure line.

2. A fuel injection system according to claim 1, characterized in that said adjusting means for controlling the moment of injection comprises a roller ring having rollers which tightly engage a front surface of a stroke disc tightly connected to said injection pump piston, said front surface being provided with cam means, and further wherein said roller ring includes means which are displaceable by said electro-fluidic converter.

3. A fuel injection system according to claim 1, characterized in that said adjusting means for controlling said quantity of injection comprises a governor slide which encompasses a limited area of said pump piston and is arranged to control fuel flow in said injection pump piston, said governor slide further including means operatively connected therewith and said means further being displaceable by said electro-fluidic converter.

4. A fuel injection system according to claim 1, whereby a plurality of pump pistons form a series injection pump in said fuel injection system, characterized in that a slidable element which can be displaced by said electro-fluidic transducer is arranged to cooperate with an adjusting rod which influences said pistons of said series injection pump.

5. A fuel injection system according to claim 2, in which said electro-fluidic converter includes an electro-fluidic transducer characterized in that a fluidic intensifier is interposed between said electro-fluidic transducer and said means which is displaceable by said electro-fluidic converter.

6. A fuel injection system according to claim 2, characterized in that said roller ring further includes a circumference having a governor curve, said governor curve arranged to be scanned by a closed loop feedback means associated with said electronic control device.

7. A fuel injection system according to claim 3, characterized in that said governor slide cooperates with a movable structural element, said structural element being connected to a closed loop feedback means associated with said electronic control device.

8. A fuel injection system according to claim 4, characterized in that said adjusting rod cooperates with a closed loop feedback means associated with said electronic control device.

9. A fuel injection system according to claim 6, characterized in that said closed loop feedback system comprises a potentiometer.

10. A fuel injection system according to claim 5, characterized in that said outlet lines of said fluidic transducer are connected to control inlets of said fluidic intensifier.

11. In a fuel injection system according to claim 3, the improvement wherein a spring element is provided between said electro-fluidic transducer and said governor slide, said spring element being arranged to return a fuel injection quantity to zero upon failure of the electronic control device.

* * * * *